US009543061B2

(12) United States Patent
McErlean et al.

(10) Patent No.: US 9,543,061 B2
(45) Date of Patent: Jan. 10, 2017

(54) CABLE ASSEMBLY, CONNECTOR APPARATUS AND METHOD

(71) Applicant: Emblation Limited, Alloa (GB)

(72) Inventors: Eamon McErlean, Alloa (GB); Gary Beale, Alloa (GB)

(73) Assignee: EMBLATION LIMITED, Inglewood (GB)

( * ) Notice: Subject to any disclaimer, the term of this patent is extended or adjusted under 35 U.S.C. 154(b) by 31 days.

(21) Appl. No.: 14/403,853

(22) PCT Filed: May 30, 2013

(86) PCT No.: PCT/GB2013/051442

§ 371 (c)(1),
(2) Date: Nov. 25, 2014

(87) PCT Pub. No.: WO2013/179046

PCT Pub. Date: Dec. 5, 2013

(65) Prior Publication Data

US 2015/0187465 A1 Jul. 2, 2015

(30) Foreign Application Priority Data

May 30, 2012 (GB) ..... 1209573.3

(51) Int. Cl.
*H01R 24/38* (2011.01)
*H01R 43/00* (2006.01)
(Continued)

(52) U.S. Cl.
CPC ..... *H01B 11/1813* (2013.01); *H01B 11/1891* (2013.01); *H01R 13/005* (2013.01);
(Continued)

(58) Field of Classification Search
CPC ... H01R 13/005; H01R 24/38; H01R 11/1813; H01R 11/1891; H01R 13/639; H01R 13/658; H01R 43/00; H01R 39/64; H01R 9/05; H01R 13/00
(Continued)

(56) References Cited

U.S. PATENT DOCUMENTS 4,846,714 A * 7/1989 Welsby ..... H01R 13/62 285/316
5,370,676 A * 12/1994 Sozanski ..... A61B 18/1815 607/101
(Continued)

FOREIGN PATENT DOCUMENTS

CN 201893160 7/2011
CN 201904123 7/2011
(Continued)

OTHER PUBLICATIONS

International Search Report dated Jan. 31, 2014 in Application No. PCT/GB2013/051442.
(Continued)

*Primary Examiner* — Timothy Thompson
*Assistant Examiner* — Michael F McAllister
(74) *Attorney, Agent, or Firm* — Snell & Wilmer L.L.P.

(57) ABSTRACT

A connector apparatus for connecting to a cable assembly that comprises coaxial cable and at least one wire and/or fluid conduit and/or further layer, wherein the connector apparatus comprises a housing that houses a connector and at least one further connector, wherein the connector is configured to electrically connect to the coaxial cable when the connector apparatus and the cable assembly are in an engaged state, the at least one further connector is configured to connect to the at least one wire and/or fluid conduit and/or further layer when the connector apparatus and the
(Continued)

cable assembly are in the engaged state, the connector is configured to allow free rotation relative to the connector of the coaxial cable around an axis when the coaxial cable is electrically connected to the connector in the engaged state.

15 Claims, 7 Drawing Sheets

(51) Int. Cl.
*H01R 13/658* (2011.01)
*H01B 11/18* (2006.01)
*H01R 13/00* (2006.01)
*H01R 13/639* (2006.01)
*H01R 39/64* (2006.01)

(52) U.S. Cl.
CPC ..... *H01R 13/639* (2013.01); *H01R 13/658* (2013.01); *H01R 24/38* (2013.01); *H01R 43/00* (2013.01); *H01R 39/64* (2013.01); *Y10T 29/49174* (2015.01)

(58) Field of Classification Search
USPC ..... 174/251
See application file for complete search history.

(56) References Cited

U.S. PATENT DOCUMENTS 5,406,951 A * 4/1995 ten Hoff ..... A61B 8/12 600/463
6,468,100 B1 * 10/2002 Meyer ..... H01R 24/542 439/312
6,612,849 B1 * 9/2003 Scott ..... H01R 39/64 439/23
6,824,415 B2 * 11/2004 Wlos ..... H01R 13/6276 439/348
2003/0156900 A1 8/2003 Vaitkus et al.
2007/0167827 A1 * 7/2007 Masters ..... A61B 8/12 600/463
2009/0270737 A1 * 10/2009 Thornton ..... A61B 8/12 600/466
2009/0275838 A1 * 11/2009 Marshall ..... A61B 8/12 600/463
2011/0201232 A1 8/2011 Islam

FOREIGN PATENT DOCUMENTS

CN 201975160 9/2011
CN 202076034 12/2011
CN 202189172 4/2012
EP 1487067 12/2004
JP 09308634 12/1997

OTHER PUBLICATIONS

Written Opinion dated Jan. 31, 2014 in Application No. PCT/GB2013/051442.
Communication Pursuant to Article 94(3) EPC dated Jan. 4, 2016 in European Application No. 13727965.9.
Office Action dated May 24, 2016 in Chinese Application No. 2013800403059.

* cited by examiner

CABLE ASSEMBLY, CONNECTOR APPARATUS AND METHOD

CROSS-REFERENCE TO RELATED APPLICATIONS

This application is a U.S. national phase filing under 35 U.S.C. §371 of PCT/GB2013/051442 filed May 30, 2013. PCT/GB2013/051442 claims priority from GB Application No. 1209573.3 which was filed on May 30, 2012, all of which are incorporated herein by reference in their entirety.

FIELD OF THE INVENTION

The present invention relates to a method, cable assembly and connector apparatus for delivery of electromagnetic energy. The invention may have particular application to microwave energy delivery in medical applications where microwave energy is delivered to a tissue target. The medical application may comprise the ablation, coagulation and haemostasis of tissue using microwave energy.

BACKGROUND TO THE INVENTION

Microwave ablation of tissue requires electromagnetic energy at microwave frequencies to be delivered to a target site via a cable used as a conduit to contain the energy between the inner and outer electrical conductors in a coaxial arrangement. There are some limitations with using coaxial cables for this type of energy delivery. The power handling of microwave cables is related to a number of factors such as frequency of operation, cable diameter, and dielectric filling. The dielectric filling of the cable possesses a loss property which absorbs energy creating heat. The ratio of inner to outer conductor surface area also affects this loss property by focusing the power transported by the dielectric.

Typically, thin microwave cables have higher loss and cannot accommodate power compared to larger diameter cables. In turn larger cables are more rigid and feel restrictive for the user. In medical applications dexterity is an important human factor in surgical treatments and it is desirable for medical devices not to significantly impinge upon the user's freedom.

In applications where energy is reflected by the termination, for example in medical ablations, this type of cable heating problem is compounded as the returning reflected energy is absorbed and dissipated as heat by the cable. In addition this return energy is superimposed onto the delivered energy as a result of voltage standing wave (VSW) creating localised excessive heating (hotspots) within the cable at fixed points. This can be particularly problematic in medical applications where stringent regulations govern the temperature of patient and user contacting parts to prevent inadvertent burns from cabling.

Additionally this phenomenon can shorten the lifetime of cables by burning the dielectric at the hotspot location by creating absorbing regions that increase the attenuation within the cable.

One method to overcome the issues with cable heating is to use a thin cable with a circulating cooling fluid jacket. The result of this approach is a flexible cooled cable however it can be easily damaged and has lower power handling performance coupled with complex waterproof encapsulation which has the possibility to leak resulting in expense to manufacture and reliability issues. Other methods include covering the cable with extra insulation layers which tend to increase the rigidity and traps the heat or placing the cable through a folded support platform (cardboard or plastic) to separate the cable from the patient.

Another aspect of design in medical applications is unwanted electromagnetic radiation emission. In medical microwave applications unwanted radiation is often not necessarily at the frequency of the treatment (for example 1-10 GHz) and may occur at other radio frequencies such as for example in the 5-200 MHz ranges causing electromagnetic interference (EMI) to nearby equipment. There are medical device and FCC requirements and standards set to limit this type of non-intended radiation which pose a challenge to system designers. Problems may arise when the connecting cabling is electrically isolated from the system ground or "floating". One issue with this approach is that the cable is at a different electrical potential to the system ground such as in Type B floating medical devices (Type BF). Spurious emissions from internal circuitry and internal wiring that are normally contained with the enclosure induce currents on the floating components. Any cable connected to the floating parts carries off these currents and acts as an antenna as it emerges from the system ground plane creating the unwanted radiation. Some techniques involve connecting the outer of the microwave coaxial cable to the zero volt side of an isolated power supply which may also include bypass capacitor(s) to couple high frequency noise to the system ground.

Microwave cables are typically manufactured using industrial microwave techniques with connectors attached to the outer and inner conductors of the coaxial cable. The connectors are then fastened to a port and typically locked into place. As they are affixed at one side these type of cables possess a torsional rigidity and hence lack fluidity during use, in some instances they will tend to coil or will resist being straightened. This becomes more pronounced with larger cables which also have increased weight and limits the freedom of the end user.

In many treatments the cable and applicator are integrated and after use the entire assembly is disposed leading to a significant additional expense for the procedure. Microwave cables are typically very expensive due to the materials and manufacturing tolerances required to achieve microwave performance. This expense tends to increase with the operational frequency and loss/performance specification of the cable. One option is to retain the majority of the cable between treatments and use a short interconnected disposable applicator/cable portion for the patient. The benefits of this are that the long cable can be low loss high specification to maximise the energy delivery with the disposable portion being low cost to reduce the manufacturing and subsequent treatment costs. This approach is however limited due to the fragility of the cable as the coaxial structure is particularly sensitive to damage especially at microwave frequencies.

Cables that are crushed or excessively bent may change the coaxial ratio causing them to reflect or absorb energy resulting in poor performance.

There is therefore a need for a method and device for the delivery of microwave energy, for example in medical environments, that protects the patient and/or user from unwanted heat, is pliable by the user and offers long term mechanical protection of the cable whilst preventing unwanted electromagnetic radiation.

SUMMARY OF THE INVENTION

In a first, independent aspect of the invention there is provided a connector apparatus for connecting to a cable assembly that comprises coaxial cable and at least one wire and/or fluid conduit and/or further layer, wherein the connector apparatus comprises a housing that houses a connector and at least one further connector, wherein the connector is configured to electrically connect to the coaxial cable when the connector apparatus and the cable assembly are in an engaged state, the at least one further connector is configured to connect to the at least one wire and/or fluid conduit and/or further layer when the connector apparatus and the cable assembly are in the engaged state, the connector is configured to allow rotation of the coaxial cable around an axis, for example when the coaxial cable is electrically connected to the connector in the engaged state.

The connector apparatus may be configured so that in operation it can continue to transmit electromagnetic energy to the coaxial cable, for example microwave energy, during said rotation.

The axis may be a longitudinal axis. The connector may be configured to allow free rotation of the coaxial cable around the axis, relative to the connector. For example rotation by at least 180°, optionally by at least 360°, whilst at least the connector and a centre conductor of the coaxial cable remain electrically connected, may be provided The connector may be configured such that said axis may align with the longitudinal axis of the coaxial cable when the connector apparatus and the cable assembly are in an engaged state.

The connector may alternatively be configured such that said axis may be located at an off-axis position away with the longitudinal axis of the coaxial cable when the connector apparatus and the cable are in an engaged state.

The connector of the connector apparatus may comprise a first connection element for electrically connecting to an inner conductor element of the coaxial cable, and a second connection element for electrically connecting to a corresponding connection element electrically connected to a conductive shield of the coaxial cable, and the connector may be configured such that, when in the engaged state, the inner conductor element is in sliding contact with the first connection element and the corresponding connection element electrically connected to the conductive shield is in sliding contact with the second connection element when the coaxial cable rotates.

The connector may comprise a first connection element for electrically connecting to an inner conductor of the coaxial cable, and a second connection element for electrically connecting to a conductive shield of the coaxial cable. The connector may be configured such that, when in the engaged state, the inner conducting shield is in sliding contact with the first connection element and the conductive shield is in sliding contact with the second connection element when the coaxial cable rotates.

The at least one further connector may be for connecting to at least one wire and/or fluid conduit, and may be located at an off-axis position away from said axis.

The at least one further connector may be for connecting to at least one further layer of the cable assembly. The at least one further connector may be configured to restrict rotation of the least one wire and/or fluid conduit and/or further layer. The at least one further connector may comprise gripping means for gripping the least one wire and/or fluid conduit and/or further layer when in the engaged state.

The connector apparatus may further comprise a tension member connector for connecting to a tension member of the cable when in the engaged state.

The connector may comprise means for applying compression force to the coaxial cable or a component of the coaxial cable in a direction substantially along said axis when in the engaged state. The component of the coaxial cable may comprise a microwave connector at the end of the cable, for example an SMP, BMA or SMA connector.

The connector apparatus may comprise a bushing and optionally the means for applying compression force is arranged to apply compression force to the bushing. The bushing may be configured to attach to or otherwise engage the coaxial cable.

The connector apparatus may comprise at least one of:—at least one channel for guiding the bushing into a retained position; a locking face for engaging with a face of the bushing thereby retaining the bushing in position; a step feature for constraining the bushing against pulling forces when the bushing is in a retained position.

The connector apparatus may comprise a locking feature on a flexible tab that is configured to travel along the at least one channel and ramp over and lock behind the locking face.

The bushing may comprise a tooth and socket arrangement.

The coaxial cable may comprise an end connector, for example an SMP, BMA or SMA connector, and the means for applying compression force may be arranged to apply force between a face of the bushing and a face of the end connector. The means for applying compression force may comprise a spring.

The cable assembly may comprise a further conducting shield around the coaxial cable, and the further connector may be for connecting to the further conducting shield.

The connector may comprise a first electrical connection configured to electrically connect to a conducting shield of the coaxial cable when in the engaged state, and the further connector may comprise a second electrical connection for electrically connecting to the further conducting shield when in the engaged state, and the first electrical connection is electrically isolated from the second electrical connection thereby to enable the conducting shield and the further conducting shield to be held at different electrical potentials.

The connector apparatus may be configured to connect to a cable assembly as claimed or described herein.

In a further, independent aspect of the invention there is provided a method of providing electromagnetic energy via a cable assembly, wherein the cable assembly comprises a coaxial cable comprising an inner conductor, a conducting shield around the inner conductor, and an insulating layer separating the inner conductor and the conducting shield. The cable assembly further comprises a further conducting shield around the coaxial cable, and the method comprises maintaining the conducting shield of the coaxial cable at a first electrical potential, and maintaining the further conducting shield at a second electrical potential that is different to the first electrical potential.

The first electrical potential may be the electrical ground (0V) or "system ground" or "floating ground" in medical applications. The second electrical potential may be the chassis ground (e.g. enclosure earth).

The method may comprise connecting the cable assembly to an apparatus for providing electromagnetic energy, and electrically connecting the further conducting shield to an electrical ground of the apparatus, for example electrically connecting the further conducting shield to the housing of the apparatus, for example at electrical earth The apparatus for providing electromagnetic energy may comprise an electromagnetic energy source and the method may comprise electrically connecting the conducting shield of the coaxial cable to an electrical ground (e.g. 0V) of the electromagnetic energy source.

The electromagnetic energy may comprise microwave energy. The electromagnetic energy may comprise electromagnetic energy having a frequency between 1 MHz and 10 GHz, for example at or around 915 or 2450 MHz. The electromagnetic energy may comprise electromagnetic energy having a maximum amplitude at a frequency between 1 MHz and 10 GHz, for example at or around 915 or 2450 MHz.

The method may comprise providing microwave energy via the cable assembly.

The cable assembly may comprise a cable assembly as claimed or described herein. The method may comprise connecting the cable assembly via a connection apparatus as claimed or described herein to an apparatus for providing electromagnetic energy.

In a further, independent aspect of the invention there is provided a cable assembly comprising a coaxial cable comprising an inner conductor, a conducting shield around the inner conductor, and an insulating layer separating the inner conductor and the conducting shield, and a further conducting shield around the coaxial cable, wherein the further conducting shield is configured to be connected, in operation, to an electrical potential different to the electrical potential of the conducting shield of the coaxial cable.

The further conducting shield may comprise a substantially continuous electrically conductive layer. The further conducting shield may comprise braiding or tubing.

The cable assembly may be for connection to an apparatus for providing electromagnetic energy to the coaxial cable, and the cable assembly may be configured to be electrically connectable to a ground potential of the apparatus, for example to a housing of the apparatus.

The apparatus for providing electromagnetic energy may comprise an electromagnetic energy source and the cable assembly may be configured such that the conducting shield of the microwave coaxial cable is electrically connected to the floating electrical ground (e.g. 0V) of the electromagnetic energy source when the cable assembly is connected to the apparatus.

The cable assembly may further comprise an armour layer around the further conducting shield. The armour layer may comprise at least one of a coiled spring, brading or tubing.

The armour layer may comprise a coiled spring and the pitch of the coiled spring may be between ½ and ⅛ of the diameter of the coiled spring, optionally between ⅓ and ¼ of the diameter of the coiled spring.

The armour layer may comprise a coiled spring and the material of which the spring is formed may have a diameter of between $1/20^{th}$ and $1/5^{th}$ of the diameter of the spring, optionally a diameter of between $1/15^{th}$ and $117^{th}$ of the diameter of the spring, optionally substantially equal to $1110^{th}$ of the diameter of the spring.

The armour layer may be formed from at least one of stainless steel, carbon fibre or composite material.

There may be an air gap between the armour layer and at least one further layer of the cable assembly within the armour layer, such that in operation the armour layer and the at least one further layer do not touch for at least part of their length.

The armour layer and the at least one further layer may touch at only a limited number of points along their length, with the number and location of touching points being dependent on the curvature of the cable assembly. The at least one further layer may comprise one of the shield or the further shield or an electrically insulating layer surrounding the further shield.

The armour layer and the at least one further layer may be separated along the length of the cable assembly on average, by a separation of between 0.1 mm and 10 mm, optionally between 1 mm and 2 mm.

The cable assembly may comprise a tension member arranged lengthwise along the cable, for bearing a tensile load when the cable is placed under tension. The tension member may be configured to bear a tensile load of at least 10N for 10 minutes when the cable is placed under tension.

The tension member may comprise at least one of rope, string, wire or cord. The tension member may have a breaking strain or elastic limit substantially greater than at least one, optionally all, of the other components of the cable assembly. The tension member may have an elastic modulus substantially higher than at least one, optionally all, of the other components of the cable assembly. The elastic modulus may be in the range 20,000-120,000 MPa.

The cable assembly may further comprise at least one fluid conduit located between the conducting shield of the coaxial cable and the further conducting shield.

The cable assembly may further comprise at least one further cable located between the conducting shield of the coaxial cable and the further conducting shield. The conducting shield around the inner conductor, the insulating layer, and the further conducting shield may have substantially the same longitudinal axis as a longitudinal axis of the inner conductor.

The at least one fluid conduit and/or the at least one further cable may each have a longitudinal axis that is different from the longitudinal axis of the inner conductor.

In a further independent aspect of the invention there is provided an apparatus or method for enclosing a microwave coaxial cable.

The apparatus may comprise an armour component to protect the coaxial cable;

a shield component to prevent unwanted electromagnetic radiation;

a flexible insulating thermal barrier.

The apparatus may comprise an armour component consisting of a coiled spring of stainless steel or carbon fibre or other metal or composite material to protect the microwave coaxial cable from crushing forces and to prevent excessive over bending of the cable.

The apparatus or method may also comprise having the spring arranged to have an elongated pitch spacing such that it cannot be easily flattened or collapsed. For example one possible embodiment is a 0.7 mm diameter stainless steel wire spring with pitch 1.5-3 mm and outside diameter of 5-10 mm or larger. Ideally the pitch should be ¼ to ⅓ the diameter with the wire being approximately 1/10 the diameter to provide the necessary strength.

The apparatus may further comprise a shield component constructed from an electrically conductive continuous covering (such as a braiding or tubing) that encapsulates the microwave cabling and may include other cabling such as communication wiring or other conductive elements or piping for gas or fluids.

The shield component may also be the armour or alternatively may also be connected to the armour such that the armour and shield are at the same electrical potential. The microwave cable and any other interconnecting wiring would be electrically insulated and therefore electrically isolated from the shield to maintain patient safety this represents a means of patient protection (MOPP).

The shield component may be directly connected to the chassis ground (earth) thus choking off the ability for the internal floating microwave cable to emit unwanted radiation. The shield and armour may be encapsulated in a flexible insulating coating to provide mechanical protection and also to electrically isolate the end user and patient from the chassis ground to maintain safety; this represents an additional means of patient protection (MOPP).

The method may also comprise having the armour, shield and flexible insulating coating serve to thermally isolate the user or patient from the inner cabling. Stainless steel may be used as a thermal barrier due to the poor thermal conductivity of this material. As the cable only periodically contacts the stainless steel armour along its length thermal conduction would be minimised.

In an alternative embodiment, a coiled metallic thermal conductor could also act as a heat equalisation mechanism as heat transferred to the coil at fixed points will travel bi-directionally along the coil and re-radiate being cooled by thermal convection within the conduit. The coil could be coated internally and/or externally with silver tape or paint.

The apparatus may also comprise an insulating jacket such as platinum cured silicone, vinyl, nitrile or any other flexible plastic, polymer or rubber material having good thermal insulation properties applied over the armour to act as a further layer of thermal insulation. The jacket may also be painted internally with silver paint or lined with silver foil to further minimise radiated heating.

In another independent aspect of the invention there is provided a housing means for locating a microwave cable, the housing means being connectable to, or comprised within, a cable assembly apparatus as claimed or described herein, and comprising a locating means configured to permit the free axial rotation of a coaxial cable.

The housing means and locating means may comprise the following:— insulated holder to align the microwave cable and other connectors;

compression spring to maintain microwave connection;

tension member.

The apparatus may further comprise an electrically insulating holder used to hold the microwave cable in alignment with the corresponding gender of microwave connector. This holder may be realized by injection molding or a rapid manufacturing technique such as SLA manufacture.

In one embodiment the microwave cable may have a connector means that can accommodate easy connection and rotation for example in the current embodiment a zero detent force SMP or BMA female connector is used.

This holder may also contain connections for other means such as data connections or cable shield connections or fluid or gas connections. The connections could be arranged around a central axial microwave cable or could be staggered or offset in any arrangement.

The holder may permit the microwave cable to rotate independent of these connections thus removing the torque placed on the entire cable assembly. The holder may optionally be connected to the spring body to limit the overall rotation to prevent the internal wiring being excessively wrapped around the microwave cable which could cause the wiring or cabling to be pulled away from connections. The wiring may comprise individual conductors or ultrathin ribbon cable wrapped around the body of the microwave cable.

The holder may also incorporate a compression spring that ensures a robust microwave connection by pushing the connector outwards. The housing being designed to permit the spring to apply force whilst allowing the assembly to freely rotate. Another function of the holder compression spring is to provide a means to accommodate tolerances in the interconnecting parts such that during mating the connector may be able to move backward compressing the holder spring until the appropriate mate has been made, with the mate being maintained by the holder spring force. The holder compression spring is required for small and sub-miniature connectors in particular low detent connectors where small movement tolerances may easily interrupt the microwave connection.

The apparatus may further comprise a tension member such as a rope, string, wire or cord that resists stretching, for example being made from Aramid fibre such as Kevlar™. The tension member would connect with the microwave cable holder at either end of the cable assembly and would prevent the entire assembly being overstretched. The tension member prevents excessive pulling forces being placed upon the microwave connectors inside the assembly which with enough force could disconnect the microwave connectors off the ends of the microwave cable causing damage. The entire assembly could be fitted into standard medical connection solution such as the Amphenol Pulse-LOK™ to create a robust multi-contact/hybrid connection that can be rapidly engaged or disengaged.

There may also be provided an apparatus, cable assembly, connector or method substantially as described herein with reference to the accompanying drawings. It should be understood that the embodiments described herein are merely exemplary and that various modifications may be made thereto without departing from the scope of the invention.

One example of a scenario incorporating the inventions may be in an RE/microwave interconnecting cable for an invasive ablation or hyperthermia treatment. This type of device may be intended to be reused for the lifetime of the product. A disposable treatment antenna may attached to the interconnect cable and after treatment only this small portion being discarded.

The invention may provide for protection of cable whilst ensuring that the cable remains flexible and also providing electrical shielding for EMC purposes.

Any feature of one aspect or embodiment of the invention may be applied as a feature of any other aspect or embodiment of the invention, in any combination.

BRIEF DESCRIPTION OF DRAWINGS

Embodiments of the invention are now described, by way of non-limiting example, and are illustrated in the following figures, in which:—

FIG. 2(*b*) is a longitudinal cross-sectional illustration of a microwave energy delivery system interconnect cable assembly according to some embodiments of the invention;

FIG. 4(*b*) is an illustration of a cable retention mechanism according to some embodiments of the invention.

DETAILED DESCRIPTION OF THE EMBODIMENTS

Reference will now be made in detail to compositions or embodiments and methods of the invention, which constitute the best modes of practicing the invention presently known to the inventors. However, it will be understood by those skilled in the art that the claimed subject matter may be practiced without these specific details. In other instances, well-known methods, procedures, components, and circuits have not been described in detail so as to not obscure the claimed subject matter.

In the following detailed description, reference is made to the accompanying drawings which form a part hereof, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Figure 1:
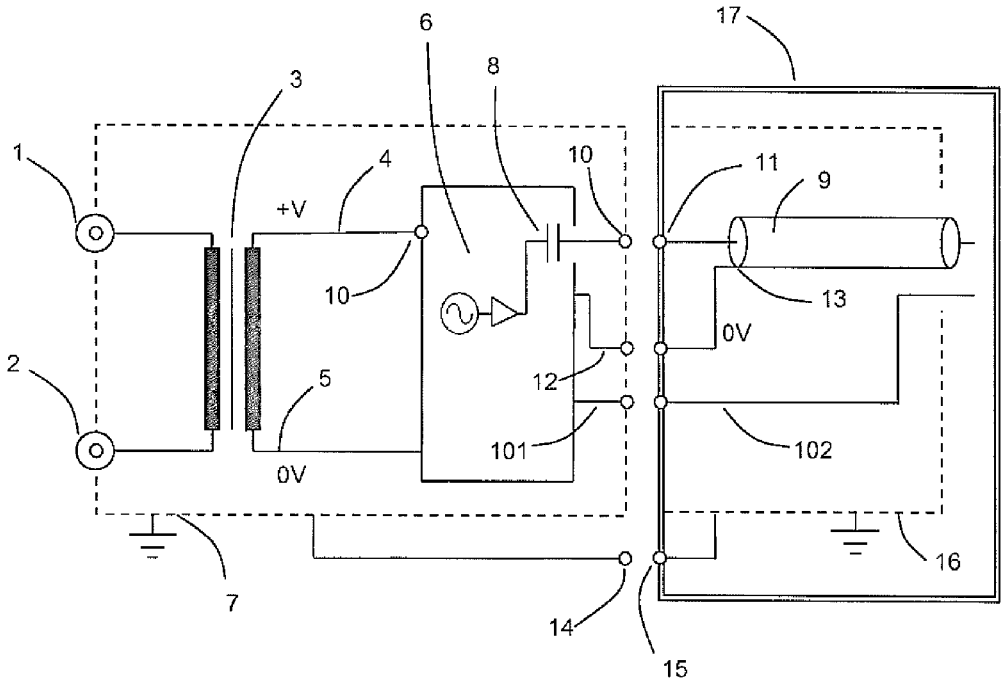
FIG. 1 is an electrical schematic illustration of a microwave energy delivery system according to some embodiments of the invention.

A system for delivering microwave energy is illustrated in FIG. 1. In this system there is a mains supply 1, 2 isolated from the supply circuitry by a medical grade isolation transformer 3 which may be a transformer, power supply unit and/or may also include a dc/dc converter, to provide a voltage supply 4 and a system ground or 0V reference 5 to power a microwave generator system 6 enclosed within an earthed enclosure 7. In medical applications requiring floating connectors the chassis earth and system ground or 0V reference may be at different potentials due to the requirement to isolate the patient from earth to prevent the risk of electrical shock.

The microwave generator system 6 includes an isolated output connected via a high voltage microwave capacitor 8 to supply the fundamental frequency. The microwave generator system is electrically isolated "floated" from the chassis ground and is powered by a type BF medical grade power supply (Craftec GNT400) to provide the required patient isolation negating the requirement for a coaxial microwave DC block. Connection to a microwave cable 9 is made via a standard slide-on microwave coaxial connector such as an SMP, BMA or SMA connector supplied by Amphenol or M/A-Com which connects the coaxial inner via connection 10-11 and the coaxial conducting shield (outer conductor) via connection 12-13 to the system ground or 0V. Data connections are made via 101-102 and may include a plurality of data lines.

The microwave coaxial cable 9 and the data lines 102 form part of a cable assembly and are shielded by a further conducting shield in the form of conductive mechanism 16 which may, for example, be a conductive spring or braided covering. Advantageously this shield is connected to the chassis earth via a connection 14-15 to enhance the EMI performance of the cable assembly. The microwave cable can exit this shield, however it is insulated and spaced accordingly to prevent it electrically contacting the shield. To prevent the patient contacting the chassis earth an insulation barrier 17 provides electrical isolation around the entire cable assembly.

The cable assembly is configured such that in operation, the conducting shield of the coaxial cable is maintained at a first electrical potential (in the embodiment of FIG. 1, the system ground) and the further conducting shield is maintained at a second, different electrical potential (in the embodiment of FIG. 1, the chassis earth).

Figure 2:
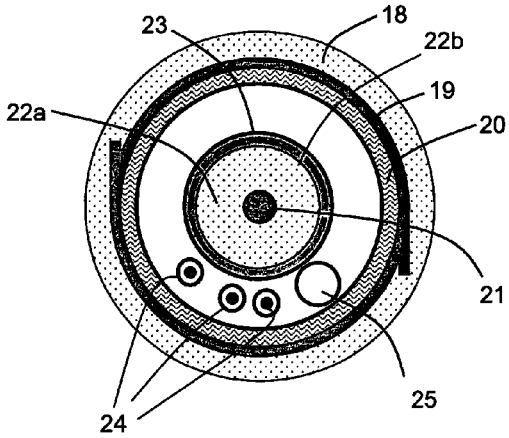
FIG. 2(*a*) is an axial cross-sectional illustration of a cable assembly according to some embodiments of the invention.
Figure 2:
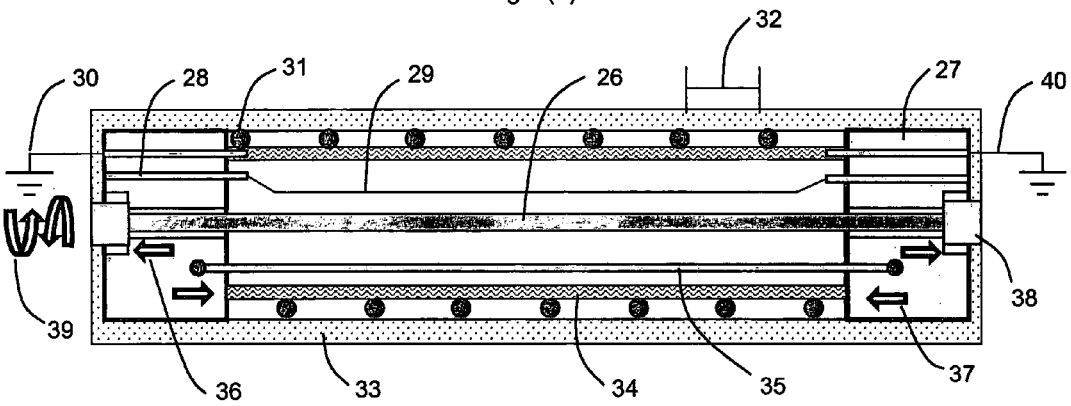

Referring to FIG. 2(*a*) a cable assembly is illustrated. In this diagram the insulating sheath 18 surrounds an armour layer in the form of an armour spring 19 which contains a shield such as a braided conductive sheath 20. The armour layer may, for example, comprise any suitable coiled spring, brading or tubing in alternative embodiments. The coaxial microwave cable 26 is located inside the centre of the shield and comprises a centre conductor 21 surrounded by a shielded dielectric 22*a*, which is in turn surrounded by an electrically conducting shield 22*b* encased in an insulated jacket 23. A number of insulated conductor wires 24 can also be contained within the assembly, likewise tubing 25 for gas or fluid or any other suitable type of fluid conduit may be contained within the assembly.

Referring to the embodiment of FIG. 2(*b*) the microwave cable 26 is held within a connector apparatus in the form of a locating fixture 27 at each end of the cable assembly. This locating fixture 27 can also hold pins or sockets 28 to allow for electrical connections 24. The internal shield 20 is connected to ground 30 via this type of connection. The armour spring 19 is arranged to be spaced with an enhanced pitch 32 to provide increased strength. The insulating jacket 18 encloses the assembly to prevent patient contact to earth. A tension member 35 is attached to the locating fixture 27 to prevent stretching forces 36 acting on the microwave cable connectors 38. Advantageously the locating fixture 27 is designed to permit the free rotation of the microwave cable 26 within the cable assembly. This feature permits the torque to be removed from the cable assembly by allowing the outer cable assembly to twist and rotate without restriction from the inner microwave cable 26.

The tension member 35 in the embodiment of FIG. 2 is a rope formed of Kevlar™ but any suitable material may be used. The tension member may have an elastic limit or breaking greater strain greater than other components of the cable 26. When the cable is held within the locating fixture, the tension member 35 may be arranged to be shorter than the coaxial cable and/or other cables 24 or conduits 25, to ensure that tension member rather than the coaxial cable 26 and/or other cables 24 bears the majority, or all, of any tensile load experienced by the cable.

In the embodiment of FIG. 2, the armour spring is a 0.7 mm diameter stainless steel wire spring with pitch 1.5 mm and outside diameter of 5 mm. Any other suitable material may be used for the armour, for example carbon fibre or any suitable metal or composite material. The insulating jacket 23 of FIG. 2 is a platinum cured silicone jacket, but any other suitable material can be used in alternative embodiments, for example vinyl, nitrile or any other suitable flexible plastic or rubber material. The jacket may, in some embodiments, be coated on its internal surface with silver paint or lined with silver foil, or covered or coated with other thermally reflective material.

An air gap may be provided inside the armour layer in some embodiments, to reduce thermal contact between the coaxial cable and outer layers of the cable assembly.

Figure 3:
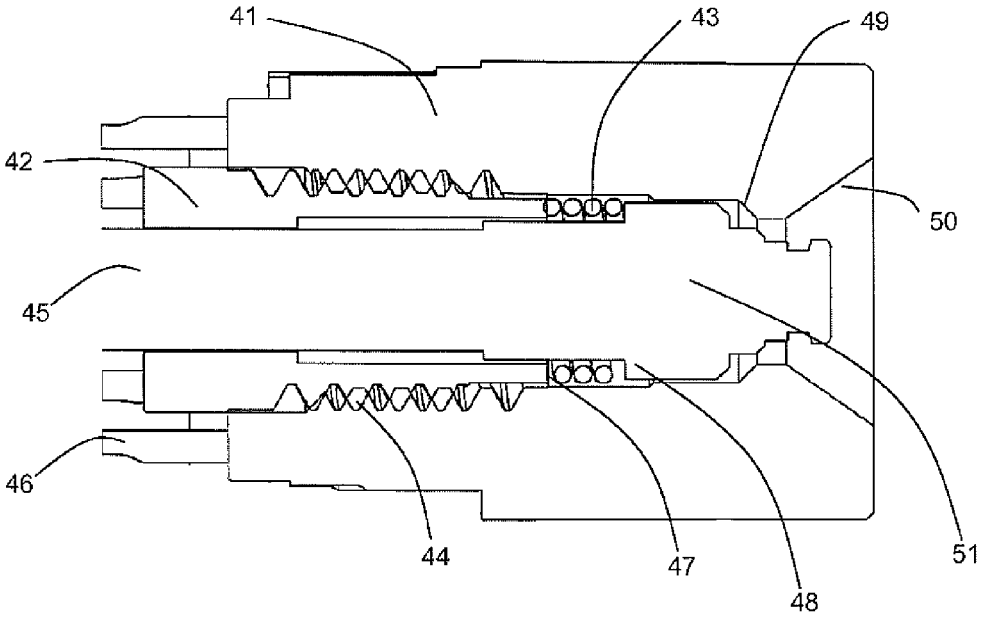
FIG. 3 is a longitudinal cross-sectional illustration of a microwave energy delivery system interconnect cable assembly according to some embodiments of the invention.

Referring to FIG. 3 the embodiment describes detail of a connector apparatus in the form of the locating fixture 27. In this illustration a housing in the form of a main body 41 of insulating material contains locations to accommodate coaxial microwave cabling 45 including in a cable assembly, such that the coaxial microwave cabling is electrically connected to a connector when it is accommodated in the body and engaged. The housing also contains at least one further connector in the form of electric connecting pins or sockets 46. The electric connecting pins or sockets 46 are configured to connect to one or more wires, such as wires 24 or further cables that may be included in the cable assembly. In alternative embodiments the pins or sockets 46 may be supplemented or replaced by a connector configured to connect to a fluid conduit that may be included in a cable assembly.

A bushing fixture 42 prevents the microwave connector 51 from being withdrawn. The microwave cable 45 enters the bushing 42 and is restrained within it. The bushing 42 connects to the main body 41 via a thread 44, optionally this may be a friction fit or other fitment such as locking ramps. A compression spring 43 pushes the microwave connector outward towards a tapered mating face 49 which ensures alignment concentricity. The main body 41 also features a ramped insertion port 50 to ensure that connections align properly prior to mating. The compression spring 43 mates with a parallel face 47 on the bushing to prevent the spring lodging between the bushing and the microwave connector. The compression spring 43 mates with another parallel face 48 on the microwave connector 51 to deliver the retention force and to permit the microwave connector to turn freely inside the assembly.

Figure 4:
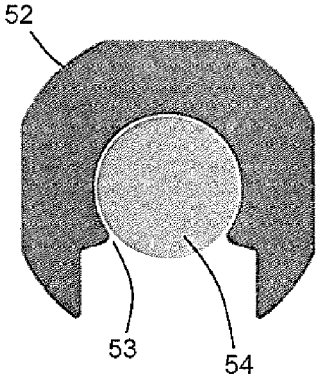
FIG. 4(*a*) is an illustration (end view) of a cable retention mechanism according to some embodiments of the invention.
Figure 4:
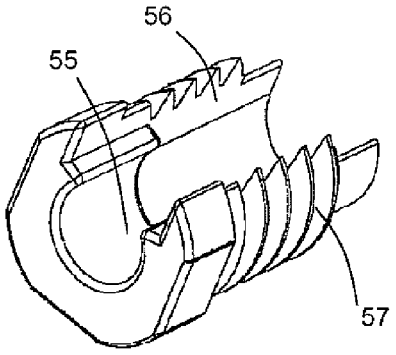

Referring to FIG. 4 (*a*) the microwave cable 54 is inserted through a c-cut into the bushing 52 and retained by a collar feature 53 which maintains the axial alignment of the cable 54. The fit is such that the cable is permitted to rotate. In an alternative view illustrated in FIG. 4 (*b*) the microwave cable is held in alignment by the internal face 55. Advantageously the C shaped cut region 56 permits the bushing to be added to the cable after the cable has been manufactured. The moulded thread 57 also possesses the C shaped cut and the material (Visijet SLA acrylic as an example) can flex to accommodate the cable. The bushing may also be fabricated without a cut-out and may be incorporated with the cable prior to addition of the connectors. Alternatively the cut away portion may be also be added to the bushing to provide additional strength in the housing.

In alternative embodiments the locating fixture 27 includes a tension member connector for connecting to a tension member of the cabling, for example tension member 35, when in an engaged state.

Figure 5:
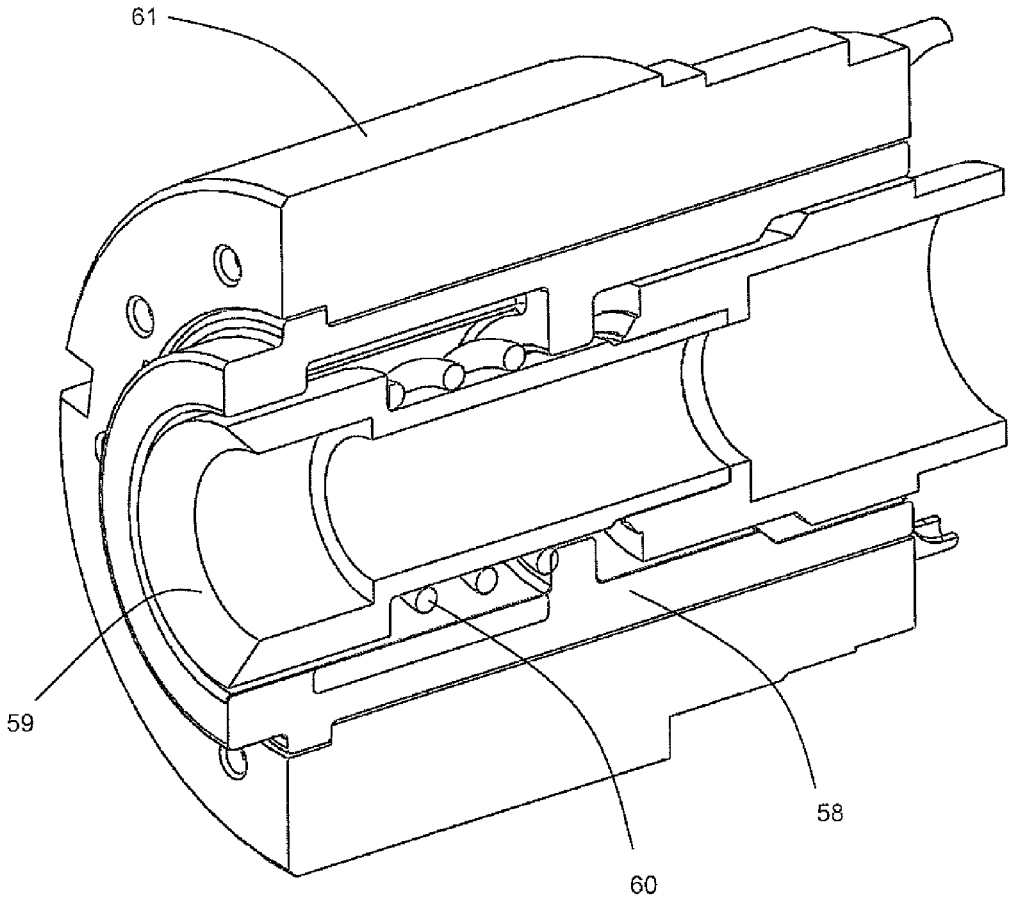
FIG. 5 is an isometric view of an alternative cable retention mechanism according to some embodiments of the invention.

Referring to FIG. 5 a bushing arrangement according to an alternative embodiment is illustrated. This embodiment permits the retention of a connector without the requirement for the connector to pass through small orifices during assembly.

Figure 6:
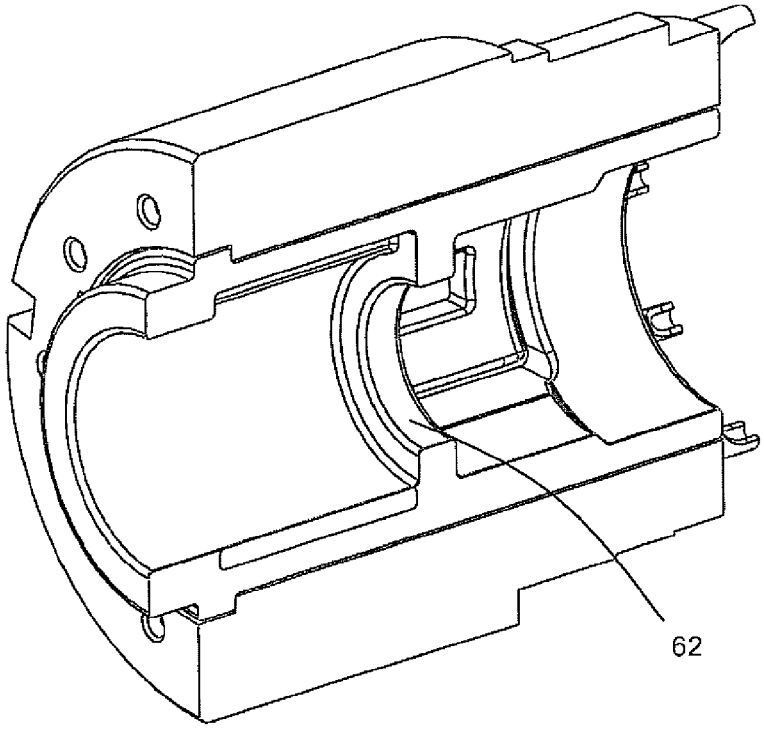
FIG. 6 is an isometric view of an alternative cable retention mechanism according to some embodiments of the invention detailing a bushing design.

In this embodiment the bushing 58 retains a sprung connector such as a BMA connector 59 with spring loading 60 inside a standard Alden PL1200 connector core housing 61. Referring to FIG. 6, the bushing 58 has an internal cylindrical rib 62 which captures the spring 60.

Figure 7:
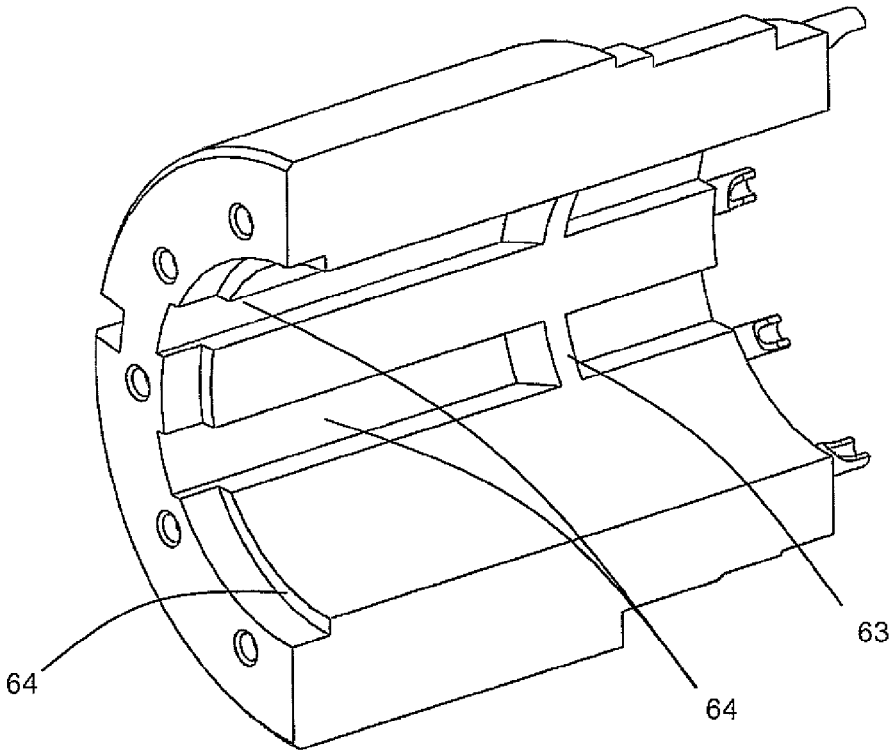
FIG. 7 is an isometric view of an alternative cable retention mechanism according to some embodiments of the invention detailing alignment features.

Referring to FIG. 7, the bushing 58 slides into position along channels 64 and is retained against a ramp and locking face 63 and constrained against pulling forces by a front step feature 64.

Figure 8:
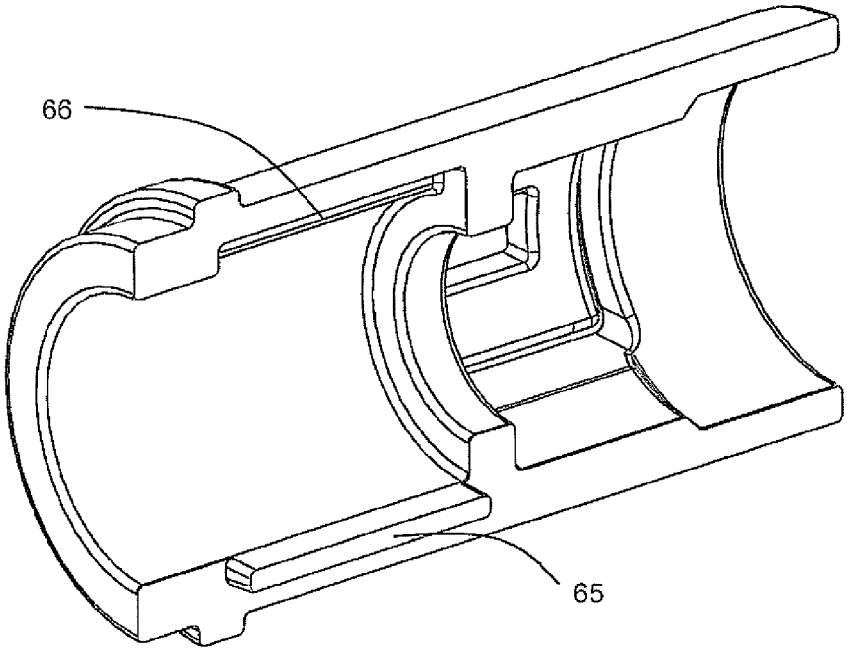
FIG. 8 is an isometric view of an alternative cable retention mechanism according to some embodiments of the invention detailing locating features.

Advantageously the bushing 58 features a tooth 65 and socket 66 arrangement as illustrated in FIG. 8 permitting the manufacture of identical mating parts.

Figure 9:
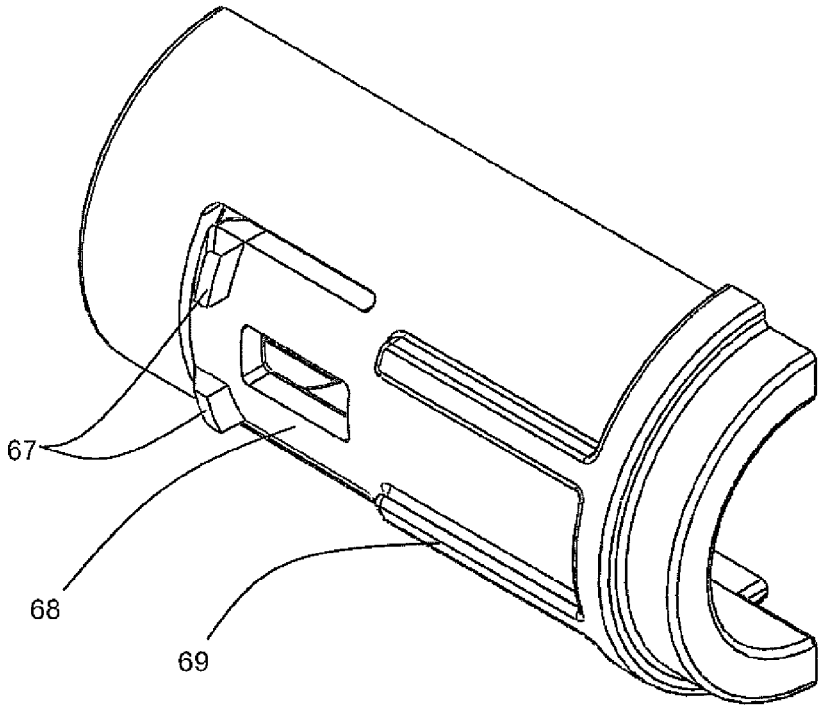
FIG. 9 is an isometric view of an alternative cable retention mechanism according to some embodiments of the invention detailing locking and alignment features.

Referring to FIG. 9 the bushing 58 features ramped locking features 67 mounted on a flexing tab 68 which travels along the channels 64 and ramps over and locks behind the ramped locking face 63.

Additional rib features 69 are included to guide the parts along the channels 64 and prevent misalignment and mechanical support. The assembly involves passing the BMA connector 59 through a PL1200 core 61 and placing a pair of bushings 58 over the BMA connector 59, capturing the spring 60 and then returning this assembly back into the core to be locked into position.

Figure 10:
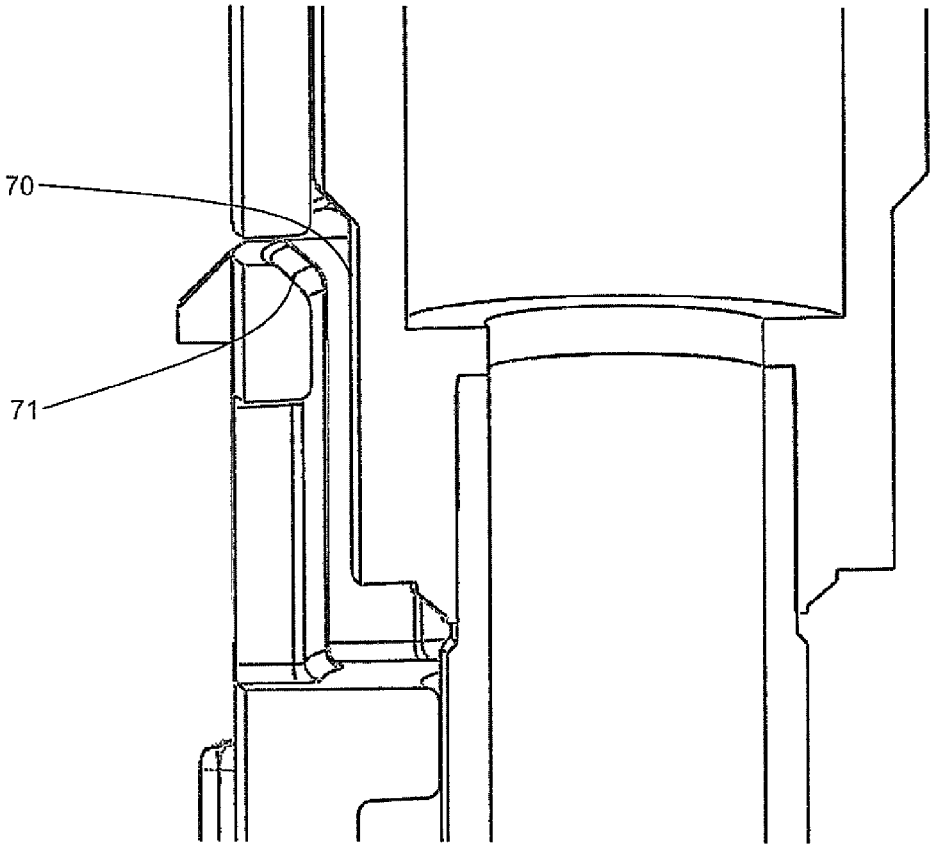
FIG. 10 is a longitudinal cross-sectional illustration of an alternative cable retention mechanism according to some embodiments of the invention detailing locking feature clearance.

Referring to FIG. 10 the flexing tab 68 is designed to have sufficient clearance between the inner face 70 and the BMA connector outer face 71. This clearance is designed to be more than the height of the locking ramp 67 to permit the assembly to pass over all the ramped locking faces 63 located along the channels 64 in the PL1200 core.

It will be understood that the present invention has been described above purely by way of example, and modifications of detail can be made within the scope of the invention.

Each feature disclosed in the description, and (where appropriate) the claims and drawings may be provided independently or in any appropriate combination.

The invention claimed is:

1. A connector apparatus for connecting to a cable assembly that comprises coaxial cable and at least one of wire, fluid conduit, or further layer, wherein the connector apparatus comprises:

a housing for housing a connector and a further connector, wherein the connector is configured to electrically connect to the coaxial cable when the connector apparatus and the cable assembly are in an engaged state;

the further connector is configured to connect to at least one of the wire, the fluid conduit, or the further layer when the connector apparatus and the cable assembly are in the engaged state;

the connector apparatus is configured to allow free rotation of the coaxial cable around an axis when the coaxial cable is electrically connected to the connector in the engaged state.

2. The connector apparatus according to claim 1, wherein the further connector is for connecting to at least one of wire or fluid conduit, and is located at an off-axis position away from said axis.

3. The connector apparatus according to claim 1, wherein the further connector is for connecting to the further layer of the cable assembly.

4. The connector apparatus according to claim 1, further comprising a tension member connector for connecting to a tension member of the cable assembly when in the engaged state.

5. The connector apparatus according to claim 1, wherein the connector comprises means for applying compression force to a component of the coaxial cable in a direction substantially along said axis when in the engaged state.

6. The connector apparatus according to claim 5, wherein the means for applying compression force comprises a spring.

7. The connector apparatus according to claim 1, comprising a bushing and optionally the means for applying compression force is arranged to apply compression force to the bushing.

8. The connector apparatus according to claim 7, wherein the coaxial cable comprises an end connector and the means for applying compression force is arranged to apply force between a face of the bushing and a face of the end connector.

9. The connector apparatus according to claim 7, wherein the connector apparatus comprises at least one of:

a channel for guiding the bushing into a retained position;

a locking face for engaging with a face of the bushing thereby retaining the bushing in position; or a step feature for constraining the bushing against pulling forces when the bushing is in a retained position.

10. The connector apparatus according to claim 9, wherein the connector apparatus comprises a locking feature on a flexible tab that is configured to travel along the channel and ramp over and lock behind the locking face.

11. The connector apparatus according to claim 7, wherein the bushing comprises a tooth and socket arrangement.

12. The connector apparatus according to claim 1, wherein the cable assembly comprises a further conducting shield around the coaxial cable, and the further connector is for connecting to the further conducting shield.

13. The connector apparatus according to claim 12, wherein the connector comprises a first electrical connection configured to electrically connect to a conducting shield of the coaxial cable when in the engaged state, and the further connector comprises a second electrical connection for electrically connecting to the further conducting shield when in the engaged state, and the first electrical connection is electrically isolated from the second electrical connection thereby to enable the conducting shield and the further conducting shield to be held at different electrical potentials.

14. The connector apparatus according to claim 1, configured to connect to an electromagnetic source for applying microwave energy for medical applications, wherein the connector is configured to provide for application of microwave energy from the electromagnetic source to the coaxial cable during said rotation.

15. The connector apparatus according to claim 1, wherein the connector apparatus is configured to connect to a cable assembly comprising: a coaxial cable comprising an inner conductor, a conducting shield around the inner conductor, and an insulating layer separating the inner conductor and the conducting shield; and a further conducting shield around the coaxial cable, wherein the further conducting shield is configured to be connected, in operation, to an electrical potential different to the electrical potential of the conducting shield of the coaxial cable.

* * * * *